US006437814B1

(12) United States Patent
Shimonaga et al.

(10) Patent No.: US 6,437,814 B1
(45) Date of Patent: Aug. 20, 2002

(54) INK SHEET TYPE-PRINTING APPARATUS

(75) Inventors: Sadaaki Shimonaga, Soraku-gun; Shingo Abe, Taki-gun, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/981,924

(22) Filed: Oct. 19, 2001

(30) Foreign Application Priority Data

Oct. 20, 2000 (JP) ..... 2000-321252

(51) Int. Cl.[7] ..... B41J 33/54
(52) U.S. Cl. ..... 347/217
(58) Field of Search ..... 347/217, 171; 400/120.01, 191

(56) References Cited

U.S. PATENT DOCUMENTS 5,555,012 A * 9/1996 Ellson et al. ..... 347/217
5,691,961 A * 11/1997 Paranjpe ..... 347/217

FOREIGN PATENT DOCUMENTS

| | | |
|---|---|---|
| JP | A59-207276 | 11/1984 |
| JP | A4-128053 | 4/1992 |
| JP | A5-147242 | 6/1993 |
| JP | A5-147296 | 6/1993 |
| JP | 5-155124 | 6/1993 |
| JP | 10-329346 | 12/1998 |
| JP | 11-227240 | 8/1999 |

* cited by examiner

*Primary Examiner*—Huan Tran

(57) ABSTRACT

Roll-like ink sheet is divided in a virtual manner into a plural number q of groups in the sub-scanning direction of ink sheet. In each of the groups, a plural number p of printing areas displaced in the sub-scanning direction are formed in a virtual manner. Print areas are partitioned in a virtual manner into a plurality of blocks in both main scanning direction and sub-scanning direction. Second accumulated printing ratio η2 for each of the blocks according to an image to be printed is calculated using first accumulated printing ratio η1 for each of the blocks. In a plurality of printing areas consisting of only blocks having second accumulated printing ratio η2 equal to or less than predetermined value η0, evaluation value for each of the print areas, dependent upon second accumulated printing ratio η2, is calculated. Any print area having a small consumption amount of ink is used for printing according to the evaluation value.

8 Claims, 7 Drawing Sheets

INK SHEET TYPE-PRINTING APPARATUS

BACKGROUND OF THE INVENTION

1. Field of the Invention

The present invention relates to a printing apparatus such as of a thermal transfer type, designed for use on an information processing apparatus and a communication apparatus. More particularly, it relates to a structure for deciding which portion of an ink sheet is used to print the ink sheet on a sheet of record paper in a printing system that rewinds the ink sheet in order to use the ink sheet a number of times.

2. Description of the Related Art

A thermal transfer printing system in which heat dissipated by a thermal head transfers ink of an ink sheet to a sheet of record paper in order to print the ink sheet on the sheet of record paper is well known. This art is in widespread use on printing apparatus such as a facsimile telegraph and a word processor. Although a one-time ink sheet printable single time prevails as an ink sheet employed in the printing apparatus, an ink sheet printable several times becomes even more popular.

Japanese Unexamined Patent Publication JP-A 59-207276 (1984) discloses a first prior art that copes with a one-time ribbon used on a serial thermal transfer printer. More specifically, a previously print area of the ribbon is compared with an area of the ribbon scheduled for printing, and the ink ribbon is rewound by one row when no overlap occurs between the compared two areas as mentioned above.

Japanese Unexamined Patent Publication JP-A 4-128053 (1992) discloses a second prior art that takes care of a multi-strike ink ribbon (an ink ribbon printable several times). More specifically, the number of times of use of a ribbon cassette is recorded, and pressure on a printing head is controlled in dependence upon the recorded number of times of use.

Japanese Unexamined Patent Publication JP-A 5-147242 (1993) discloses a third prior art in a thermal transfer printing apparatus that employs a multi-pass ink ribbon. More specifically, a temperature table for application on a thermal head is selectively used according to an ink ratio achieved until previous printing.

Japanese Unexamined Patent Publication JP-A 5-147296 (1993) discloses a fourth prior art in which an accumulated ratio of ink on a ribbon surface until previous printing is calculated, and an unused surface of the ink ribbon is used to practice the next printing when the accumulated ink ratio exceeds a certain level of ratio.

Even with the use of a multi-pass ink sheet or an ink sheet printable several times at the same position of the ink sheet, transfer printing is usually conducted a limited number of times. An increased number of times of transfer inevitably degrade printing quality in stages. Accordingly, the ink sheet is preferably subjected to uniform printing and ink transfer. When the ink sheet at first used is rewound for re-use, then an error in traveling of a crimped ink sheet caused by printing makes it difficult to expect that each portion of the ink sheet would be returned to the same position precisely.

There has been a need for a method for equalizing a consumption amount of ink on the ink sheet. In the fourth prior art (JP-A 5-147296) as previously discussed, the ink sheet is rewound each time when a page is printed, and a comparison is made between a previously printed bit map and a bit map to be now printed. In view of an error in traveling of the ink sheet, it would be very difficult to virtually employ a method for determining the number of times of printing according to a printing overlap per bit unit. Alternatively, the number of times of printing is determined from an accumulated ink ratio. When it is determined simply from the accumulated ink ratio at the entire print area on a page how the ink sheet is used, then the ink sheet ends up with inefficient use because there are found an area heavily worn out by printing and having a partially increased ratio of accumulated ink and a virtually non-print area that is excluded from the entire accumulated ink ratio.

SUMMARY OF THE INVENTION

An object of the invention is to provide an ink sheet type-printing apparatus designed to efficiently use an ink sheet while allowing an invariable level of printed image quality to be maintained.

Embodiments of the invention will now be summarized. In an information-processing apparatus and a communication apparatus, in which a recording method is employed for using a rewound ink sheet at least two times in a thermal transfer printing system that thermally transfers ink from the ink sheet onto a sheet of record paper, the thermal transfer printing system being used in a printing apparatus that is incorporated in the information-processing apparatus and the communication apparatus such as a facsimile telegraph and a Japanese language version of a word processor, the ink sheet is divided into several blocks in a virtual manner; first accumulated printing ratio $\eta 1$ for each of the blocks is stored, which can also be called a ratio of dots already printed; second accumulated printing ratio $\eta 2$ for each of the blocks according to an image scheduled for printing is calculated; calculated second ratio $\eta 2$ is compared with stored predetermined value $\eta 0$ of the ink sheet; and, print areas R1 to Rp are decided without the use of any print area having an increased consumption amount of ink, so as to average a total of evaluation values G for print areas R1 to Rp including the blocks.

The ink sheet is partitioned into a plurality of blocks in a virtual manner as large as compensating an error in which the ink sheet is traveled in a sub-scanning direction thereof. First and second accumulated printing ratios $\eta 1$, $\eta 2$ of the ink sheet are determined for each of the partitioned blocks. Evaluation value G is determined from first and second accumulated printing ratios $\eta 1$, $\eta 2$ for each of the print areas. Print areas of the ink sheet, which are scheduled for printing, are decided to provide an average amount of ink used on the entire ink sheet. As a result, the ink sheet can economically be used. A reduced error in traveling of the ink sheet allows the ink sheet to be used more economically.

The invention provides an ink sheet type-printing apparatus designed to use an ink sheet in recording on a sheet of record paper a number of times at a same position thereof, comprising:

moving means for permitting the ink sheet to be moved in a sub-scanning direction of thereof;

first calculating means for dividing the ink sheet in a virtual manner into a plurality of blocks in both a main scanning direction of the ink sheet and the sub-scanning direction thereof, and further for calculating accumulated printing ratios $\eta 1$, $\eta 2$ for each of the blocks, which correspond to amounts of ink to be consumed for printing;

second calculating means in response to an output from the first calculating means, for calculating an evaluation value for each of a plurality of print areas different in the sub-scanning direction of the ink sheet, the evaluation value being related to accumulated printing ratios η1, η2; and, print area-deciding means in response to an output from the second calculating means, for deciding a print area of the ink sheet to be used, according to the evaluation value, and for forcing the moving means to move the ink sheet in the sub-scanning direction of the ink sheet in order to carry out printing on a sheet of record paper using the decided print area of the ink sheet.

According to the invention, the first calculating means calculates accumulated printing ratios η1, η2 for each of the blocks of the ink sheet, while the second calculating means calculates evaluation value G for each of print areas R1 to Rp according to accumulated printing ratios η1, η2. Print areas R1 to Rp are displaced in the sub-scanning direction of the ink sheet. The print area-first accumulated printing ratio η1 for each of the blocks of the ink sheet, which is obtained after the ink sheet is printed, and the second calculating means calculates evaluation value related to second accumulated printing ratio η2.

According to the invention, the first calculating means calculates second accumulated printing ratio η2 according to an image scheduled for printing, using first accumulated printing ratio η1 for each of the blocks of the ink sheet, which is obtained after the ink sheet is printed, while evaluation value G is calculated using second accumulated printing ratio η2. As a result, precise evaluation value G for the image scheduled for printing is achievable.

According to the invention, in order to obtain evaluation value G for each of the print areas, second accumulated printing ratio η2 is calculated according to an image scheduled for printing, using first accumulated printing ratio η1 that is obtained after the ink sheet is printed. As a result, a proper print area is decided before the scheduled printing of the image is practiced, and the ink sheet is efficiently usable, resulting in improved printed image quality.

In the invention it is preferable that the print area-deciding means includes: deciding means decides a print area of the ink sheet to be printed onto a sheet of record paper, and then drives the moving means to move the ink sheet in the sub-scanning direction thereof in order to permit the decided print area to be used for printing. As a result, the ink sheet can be used a number of times at the same position thereof, and the ink sheet can efficiently be used, with a printed image quality maintained. This feature avoids wasting the ink sheet.

According to such an aspect of the invention, accumulated printing ratios η1, η2 are calculated for each of the blocks of the ink sheet. The blocks are divided in a virtual manner in the main scanning and sub-scanning directions of the ink sheet. The evaluation value is calculated for each of the print areas of the ink sheet in order to decide a print area to be used for printing. As a result, sharp printing is achievable while an image printed in the decided print area has a certain level of quality maintained. In addition, the ink sheet can efficiently be used because the above feature eliminates waste such that the ink sheet having still printable areas is discarded.

In the invention it is preferable that the first calculating means calculates second accumulated printing ratio η2 for each of the blocks of the ink sheet, responsive to the printing of an image to be printed, using accumulated printing ratio-comparing means for comparing second accumulated printing ratio η2 for each of the blocks in each of the print areas with predetermined value η0 in order to determine whether the former η2 is equal to or less than the latter η0; and, comparison-deciding means in response to an output from the accumulated printing ratio-comparing means, for deciding that any print area consisting of only blocks that have second accumulated printing ratio η2 equal to or less than predetermined η0 is used for printing.

In the invention it is preferable that the comparison-deciding means decides that from among a plurality of print areas consisting of only blocks having second accumulated printing ratio η2 equal to or less than predetermined η0, any print area having evaluation values related to accumulated printing ratios η1, η2 that correspond to a small consumption amount of ink is used for printing.

According to the invention, it is decided that print areas having second accumulated printing ratios η2 equal to or less than predetermined η0 for all of the blocks are used for printing. As a result, a sharp image can be printed throughout the print area.

From among a plurality of print areas consisting of only blocks that have second accumulated printing ratio η2 equal to or less than predetermined η0, any print area is used for printing in which evaluation value G for the print area is a value corresponding to accumulated printing ratios η1, η2 for the block having a small consumption amount of ink. As a result, the evaluation values G for the print areas to be used for printing is averaged, and the ink sheet can efficiently be used.

According to such a further aspect of the invention, any print area is used for printing, which consists of only blocks having second accumulated printing ratio η2 equal to or less than predetermined η0. As a result, the quality of printed images can be improved without being degraded.

According to the invention, from among a plurality of print areas, any printing area is used for printing, which has a value that is expressed by an evaluation value for such a print area, and further which corresponds to accumulated printing ratios η1, η2 having a small consumption amount of ink. As a result, improvements in printed image quality are achievable, and the evaluation values for the print areas are averaged, thereby allowing the entire ink sheet to be efficiently used. This feature avoids wasting the ink sheet.

In the invention it is preferable that the ink sheet is divided into a plural number q of groups in the sub-scanning direction of the ink sheet, each of the groups including a plural number p of print areas that are arranged respectively offset next to one another in the sub-scanning direction of the ink sheet, and wherein the comparison-deciding means decides that, when the print area to be used for printing is absent in a group, the print area to be used for printing in the other groups is used for printing.

According to the invention, the ink sheet, formed into a relatively long, roll-like shape, is divided into a plural number q of groups D0 to D(q−1) in a longitudinal direction or the sub-scanning direction of the ink sheet. In each of the groups, a plural number p of print areas is displaced in the sub-scanning direction of the ink sheet. When second accumulated printing ratio η2 for each of the blocks in all of the print areas in each of the groups exceeds η0 to a degree that a consumption amount of ink in the group degrades printed image quality, or when any print area to be used for printing is absent in a group, then the comparison-deciding means decides to use a new print area to be used for printing in the other groups.

As a result, the ink sheet can efficiently be used for each of the groups. Such grouping eliminates the need for the moving means to move the ink sheet by a long distance in order to set a print area to be used for printing. Consequently, movement of the ink sheet can smoothly be set in a reduced time.

According to the invention, the print area to be used for printing is decided for each of the groups in the ink sheet in the sub-scanning direction thereof. When any print area suitable for printing is absent in any group, then new print area in the other groups is decided to use. As a result, the moving means moves the ink sheet by a shorter distance, and is allowed to smoothly move the ink sheet.

In the invention it is preferable that length LB2 of the block in the sub-scanning direction of the ink sheet is set to be equal to or greater than an error ΔLB in traveling of the ink sheet.

Furthermore, in the invention it is preferable that the ink sheet has detected portions spaced apart from each other by a distance LB1 in the sub-scanning direction of the ink sheet, and the moving means includes detecting means for detecting the detected portions of the ink sheet in order to detect a position in the sub-scanning direction of the ink sheet, and movement control means in response to an output from the detecting means, for permitting the decided print area of the ink sheet to be moved to a position at which the ink sheet is printed on a sheet of record paper.

According to the invention, when the ink sheet is moved in the sub-scanning direction thereof for positioning, then predetermined blocks are used for printing, even with the presence of an error in traveling in the sub-scanning direction of the ink sheet. As a result, a certain level of printed image quality is maintained. Similarly, such blocking maintains an invariable level of printed image quality, even with the presence of an error in traveling in the main scanning direction of the ink sheet.

In order to provide accurate positioning of the ink Z7 sheet, the ink sheet is formed with the detected portions 42 such as marks. The detecting means detects the detected portions of the ink sheet, and then calculates a position in the sub-scanning direction of the ink sheet in order to detect such a position of the ink sheet. The movement control means provides accurate positioning of the ink sheet at a desired position in the sub-scanning direction of the ink sheet. The spacing LB1 of the detected portions in the sub-scanning direction of the ink sheet and the length LB2 of the block in the sub-scanning direction of the ink sheet may be set to be equal to or greater than error ΔLB in traveling in the sub-scanning direction of the ink sheet ($LB1 \geqq \Delta LB$, $LB2 \geqq \Delta LB$) in order to further improve the accuracy of positioning.

Although the ink sheet can be of a thermal transfer type, the ink sheet may be struck by distal ends of needles in order to print the ink sheet on a sheet of record paper. Electromagnetic forces per dot drive the needles. Other structures may also be acceptable.

According to the invention, the print areas are precisely positioned irrespective of an error in traveling of the ink sheet caused by crimping of the ink sheet. As a result, printed image quality can be improved.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
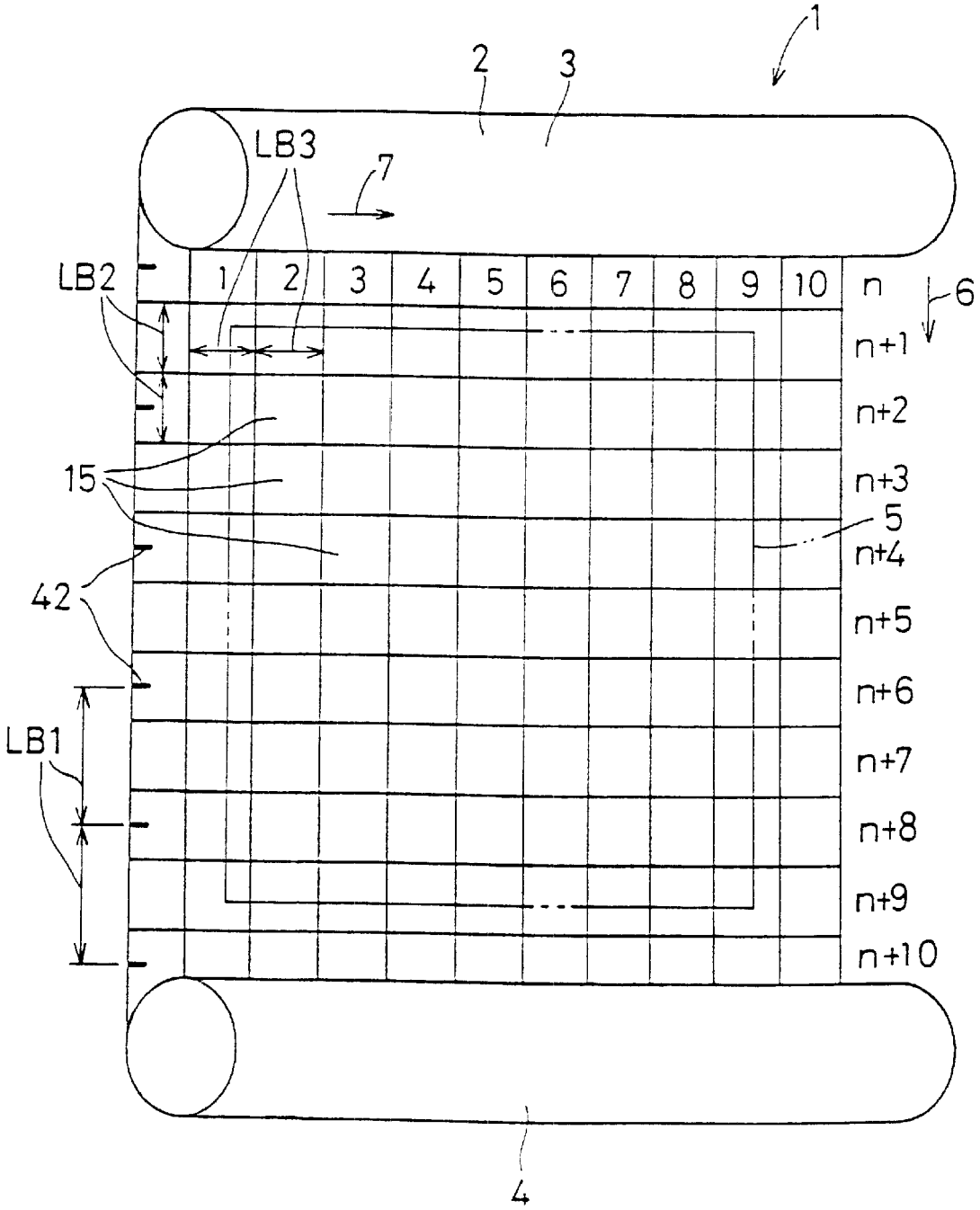
FIG. 1 is a plan view, schematically illustrating an ink sheet 2 incorporated in an ink sheet type-printing apparatus 1 according to an embodiment of the invention.

Now referring to the drawings, preferred embodiments of the invention are described below.

FIG. 1 is a plan view, schematically illustrating an ink sheet 2 incorporated in an ink sheet type-printing apparatus 1 according to an embodiment of the invention. The ink sheet 2 in the form of a roll is put on a sheet of record paper 5, while being moved in a sub-scanning direction of the ink sheet 2 in an elongated path between one roll 3 and another 4. In this way, the ink sheet 2 is printed on the sheet of record paper 5 in a thermal transfer manner. The ink sheet 2 is scanned between the rolls 3, 4 in the sub-scanning direction 6 of the ink sheet 2, together with the sheet of record paper 5, thereby printing the ink sheet 2 on the sheet of record paper 5. The ink sheet 2 is moved in a reciprocal direction with reference to the sub-scanning direction 6. The ink sheet 2 has a width extending in a main scanning direction 7 that is perpendicular to the sub-scanning direction 6. The ink sheet 2 is printed on the record paper 5 for each line that extends in the main scanning direction 7.

Figure 2:
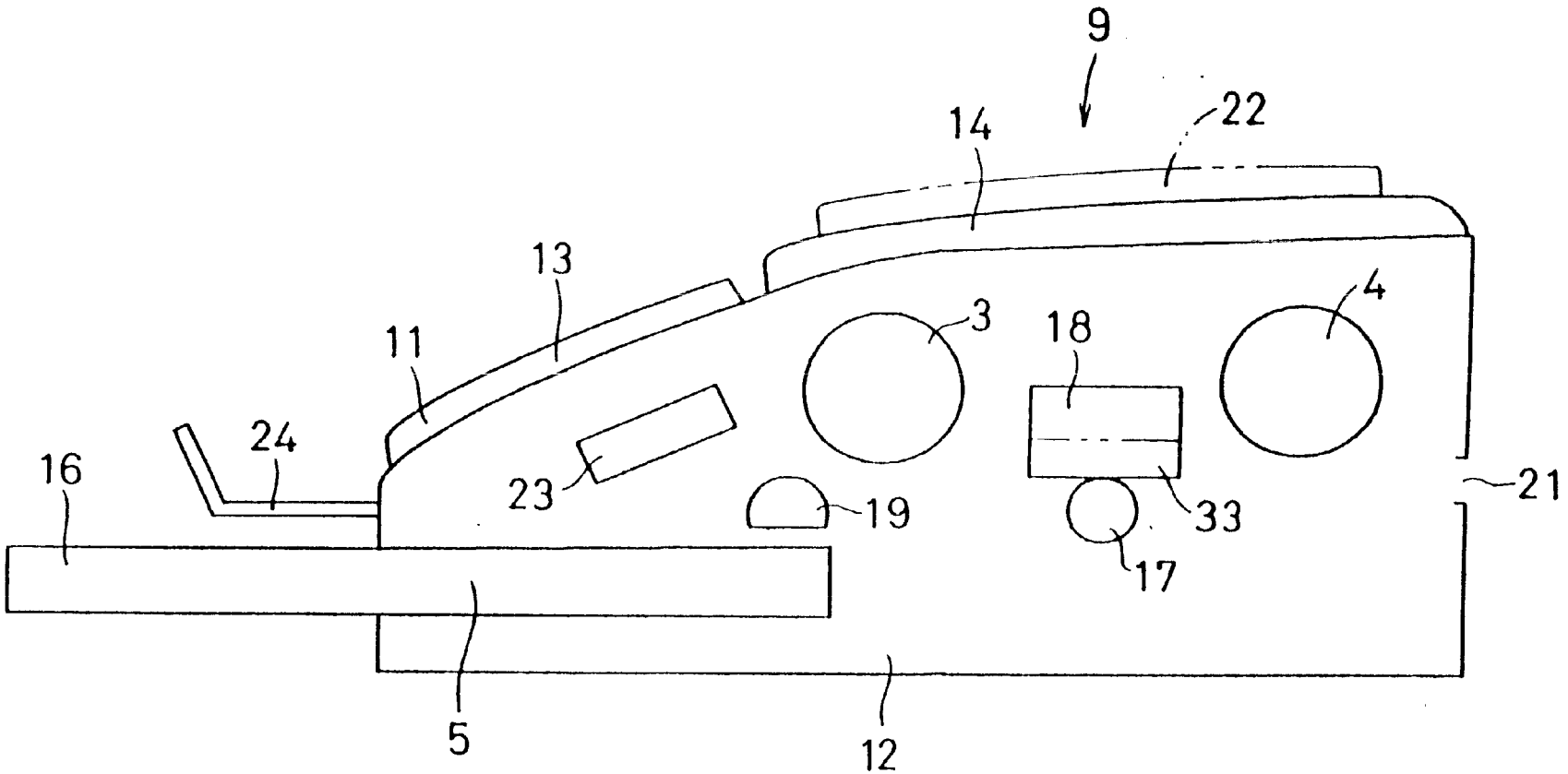
FIG. 2 is a side view, schematically illustrating a facsimile telegraph 9 disposed in the printing apparatus 1 as illustrated in FIG. 1.
Figure 3:
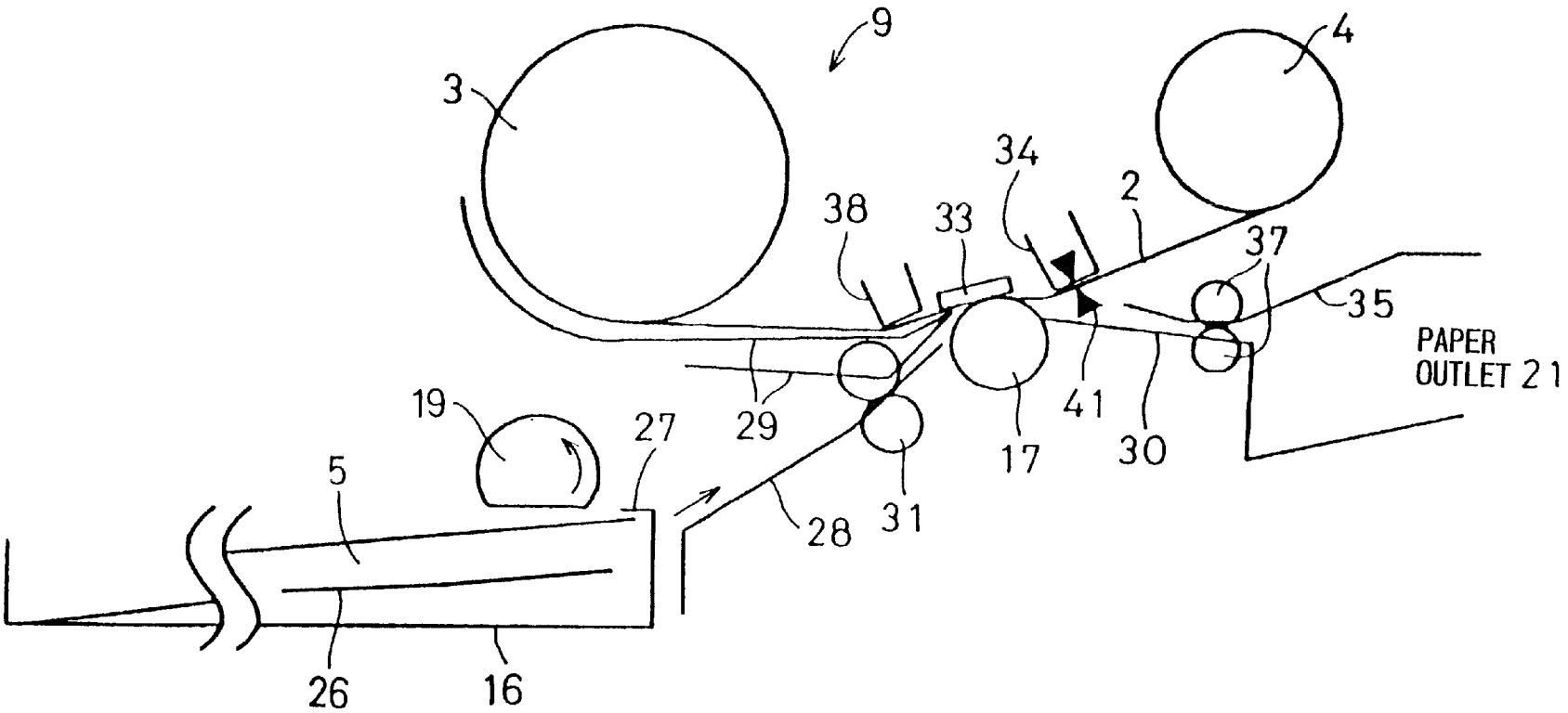
FIG. 3 is a side view, schematically illustrating a path in the facsimile telegraph 9, in which the ink sheet 2 and a sheet of record paper 5 are conveyed.

FIG. 2 is a side view, schematically illustrating a facsimile telegraph 9 having the ink sheet type-printing apparatus 1 disposed therein as illustrated in FIG. 1. FIG. 3 is a side view, schematically illustrating a path in the facsimile telegraph 9, in which the ink sheet 2 and the sheet of record paper 5 are conveyed. An outer case 11 includes a lower cabinet 12, a control panel 13, and a cover 14. A record paper cassette 16 is releasably inserted into the cabinet 12 from the front of the case 11, i.e., from the left of FIG. 2 and that of FIG. 3. The cassette 16 contains a stack of record paper 5 or cut sheets, each of which is cut into a rectangular shape. The control panel 13 includes dial buttons for dialing a telephone number in order to send a facsimile, facsimile sending-receiving buttons, and a liquid crystal display device. The control panel 13 functions as a man-machine interface for a user in order to operate the facsimile telegraph 9.

The ink sheet 2 is fed from the ink sheer roll 3, and is wound up by the winding roll 4 after being moved between a platen roller 17 and a head unit 18. A one-time ink sheet is fed in a single direction, and is replaced when a roll of the ink sheet is used up. The one-time ink sheet is subjected to main scanning while being unilaterally moved from the roll 3 to the roll 4, and ends up with single use. A multi-pass ink sheet 2 can be wound up in an opposite direction from the winding roll 4 to the ink sheet roll 3. The multi-pass ink sheet 2 can be used a number of times at the same position thereof. Since the multi-pass ink sheet 2 has a thick layer of ink applied thereto, not all of the ink on a portion of the ink sheet 2 to be printed is transferred to the record paper 5 single time of printing. Alternatively, peripheral ink is supplied to an area of the record paper 5 at which the ink is transferred from the ink sheet 2 by heat from the thermal head unit 18. As a result, the ink sheet 2 can be printed to the record paper 5 a number of times. Since peripheral pixels are affected when one pixel is printed, the ink sheet is divided into a plurality of blocks 15. According to the invention, the one-time ink sheet and the multi-pass ink sheet 2 can be replaced with one another.

A pick-up roller 19 takes each sheet of record paper 5 out of the cassette 16. Such produced sheets of record paper 5 are discharged through a paper outlet 21 after being moved between the platen roller 17 and the head unit 18. Original documents 22 to be read are disposed on the cover 14. Each of the original documents 22 is brought into the cabinet 12 through the rear of the control panel 13 or through the right of FIG. 2, and is then read by an original document-reading apparatus 23. The read documents settle on a stacker 24 above the cassette 16. In the cassette 16, the sheets of record paper 5 are loaded on a support plate 26. The support plate 26 experiences spring force that acts upward with respect to a horizontal axis or an axis vertical to the paper surface of FIG. 3 on an upstream side in a sheet-feeding direction or to the left of FIG. 3.

The rotation of the pick-up roller 19 brings the topmost sheet of record paper 5 forward, and the topmost sheet of record paper 5 is then moved beyond a record paper paw 27. This mechanism sequentially feeds each sheet of record paper 5. The fed sheet of record paper 5 is guided by upper and lower paper guide members 28, 29, and is then fed into a space between the platen roller 17 and the printing head 33 after being moved through a pair of paper-feeding rollers 31. The printing head 33 or part of the head unit 18, and a rear head frame 34 function to guide movement of the record paper 5 and ink sheet 2. The record paper 5 printed between the printing head 33 and the platen roller 17 is guided by paper guide members 30, 35, and is ultimately discharged through the paper outlet 21 by means of a pair of paper-feeding rollers 37.

The ink sheet 2 is fed from the ink sheet roll 3, and is wound up by the winding roll 4 after being guided by a front head frame 38, the printing head 33, the rear head frame 34, and the platen roller 17. When the record paper 5 is moved between the printing head 33 and the platen roller 17, then the printing head 33, the ink sheet 2, the record paper 5, and the platen roller 17 are situated at the printing head 33 above each other in sequence from the top to the bottom.

The printing head 33 has heater elements disposed thereon over the entire width of the record paper 5 in the main scanning direction 7 or in a depth direction in FIG. 3. For example, eight heater elements are arranged for each pixel for each one millimeter. A spring force causes the printing head 33 to be pressed against the platen roller 17 under a certain level of pressure. Electrical current is selectively applied to the heater elements for each dot according to image data to be printed. As a result, wax on the ink sheet 2 is heated by an amount of only dots for required pixels, and is transferred onto the record paper 5. Consequently, one line extending in the main scanning direction 7 is printed at a time, and printing is completed when the record paper 5 is moved through the printing head 33.

A position sensor 41 is an optical position sensor for reading marks 42 (see FIG. 1) on the ink sheet 2. Either reflection type or transmittance type sensor is used, depending upon a type of the mark 42. The ink sheet 2 as illustrated in FIG. 1 is divided into a plurality of blocks 15 in a virtual manner in main scanning and sub-scanning directions 7 and 6. In the embodiment as illustrated in FIG. 1, the ink sheet 2 is partitioned into a total of ten blocks in the main scanning direction 7, while reference signs n to n+10 are provided in the sub-scanning direction 6 in FIG. 1. The ink sheet is formed with a group of blocks over the entire length of the record paper 2.

Figure 4:
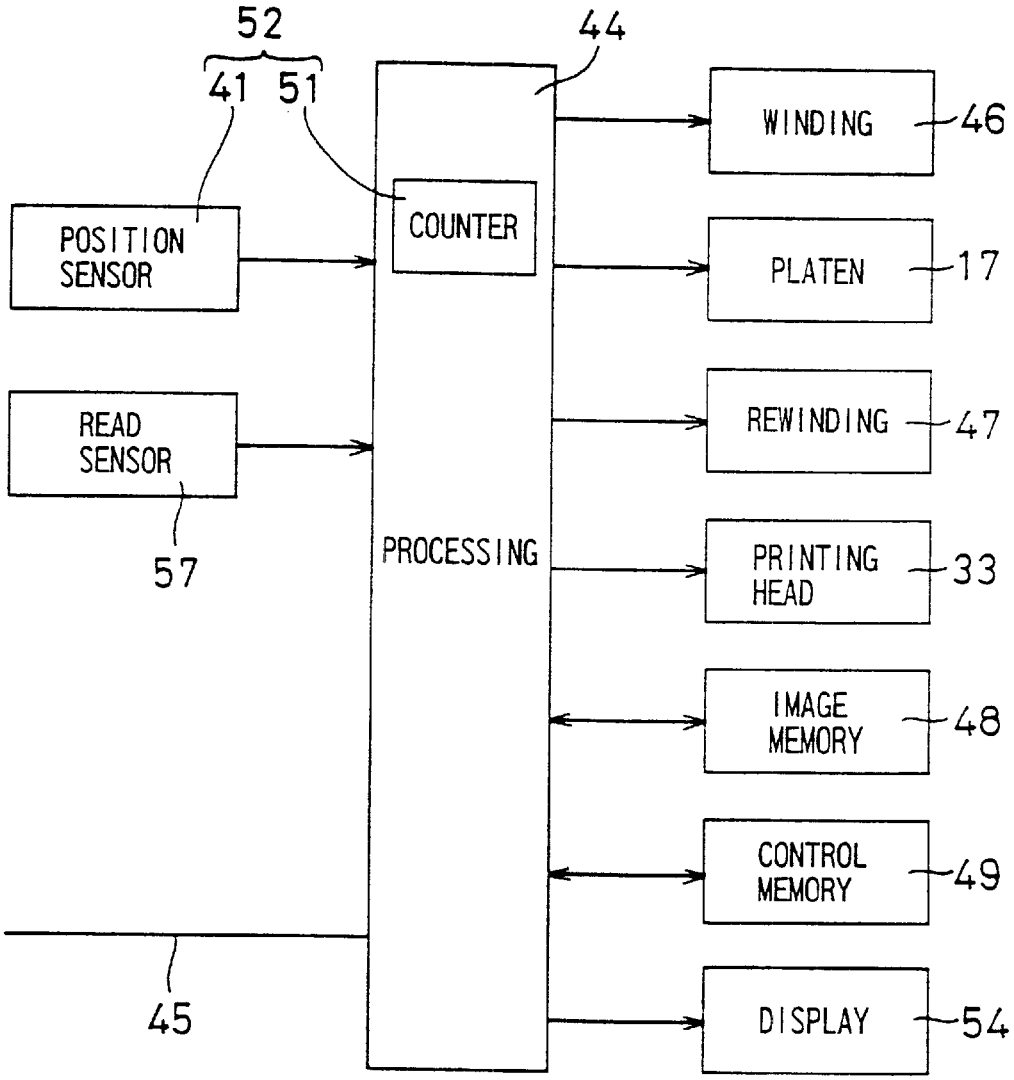
FIG. 4 is a block diagram, illustrating an electrical structure according to the embodiment as illustrated in FIGS. 1–3.

FIG. 4 is a block diagram, illustrating an electrical structure according to the embodiment of the invention as illustrated in FIGS. 1–3. A processing circuit 44 provided by a microcomputer and the like is connected to a public telephone line 45 in order to receive a facsimile signal. The processing circuit 44 drives the printing head 33 while rotating the platen 17, thereby permitting the printing head 33 to print received image data on the record paper 5 in the main scanning direction 7. At that time, a wind-driving means 46 drives the roll 4 to wind up the ink sheet 2. A rewind-driving means 47 allows the roll 3 to be turned in a reverse direction in order to rewind the ink sheet 2. As previously discussed, the image data to be printed by the printing head 33 is transmitted through the public telephone line 45, and is at first stored in an image memory 48. As previously discussed, the printing head 33 prints the stored image data. A control memory 49 stores data on control of the ink sheet 2. In sending a facsimile, a read sensor 57, which extends in an elongated space in the main scanning direction, reads an original document that is moved and scanned in the sub-scanning direction, and then sends a signal representative of an image of the read original document to a dialed receiver through the public telephone line 45.

An output of the position sensor 41 for detecting any position of in the sub-scanning direction 6 of the ink sheet 2 is supplied to the processing circuit 44. A counter 51 functions to count the marks 42 detected by the position sensor 41. The position sensor 41 and the counter 51 form a detecting means 52 for detecting any position in the sub-scanning direction 6 of the ink sheet 2.

The marks 42 indicative of respective positions in the sub-scanning direction 6 of the ink sheet 2 are located along an edge in a transverse direction or main scanning direction 7 of the ink sheet o2, at which the ink sheet 2 is normally printed. The marks 42 display positions at which the ink sheet 2 is run. The marks 42 can be transparent marks without ink being applied to the ink sheet 2 that is made of a transparent film, and can be read by a transmittance type optical position sensor 41. Alternatively, a reflector may be applied to the reverse side of the ink sheet 2 in order to form the marks 42, and a reflection type optical position sensor 41 can read the marks 42.

The ink sheet 2 may be rewound in order to reuse the same sheet surface after each page is printed. Alternatively, the ink sheet 2 may be rewound in order to start second time of printing when a total length of a roll in the sub-scanning direction 6 of the ink sheet 2 is used up one time. As a further alternative, an intermediate action between the above two actions is acceptable. Anyhow, the use of the marks 42 to check respective positions in the sub-scanning direction 6 of the ink sheet 2 makes it possible to precisely determine the position of the ink sheet 2. Two times length LB2 of each of the blocks 15 in the sub-scanning direction 6 may be set to be evenly spaced interval LB1 between the marks 42. According to the invention, spacing LB1 between the marks 42 and length LB2 of each of the blocks 15 are set to be equal to or greater than ΔLB, i.e., an error in which the ink sheet 2 is traveled in the sub-scanning direction 6. As a result, positioning can be practiced with improved precision. Tensile forces of the rolls 3 and 4 provide the elongated ink sheet 2. In addition, the ink sheet 2 tends to be elongated by the heating of the printing head 33 during printing, and thus tends to experience error ΔLB. However, the position sensor 41 detects the marks 42, thereby making it feasible to precisely detect respective positions of the blocks 15 along the sub-scanning direction 6. As previously discussed, the ink sheet 2 is divided into the blocks 15 in the main scanning direction 7 in a virtual manner. Length LB3 of each of the blocks 15 in the main scanning direction 7 may be set to be greater than an error in which the ink sheet 2 is traveled in the main scanning direction 7.

Figure 5:
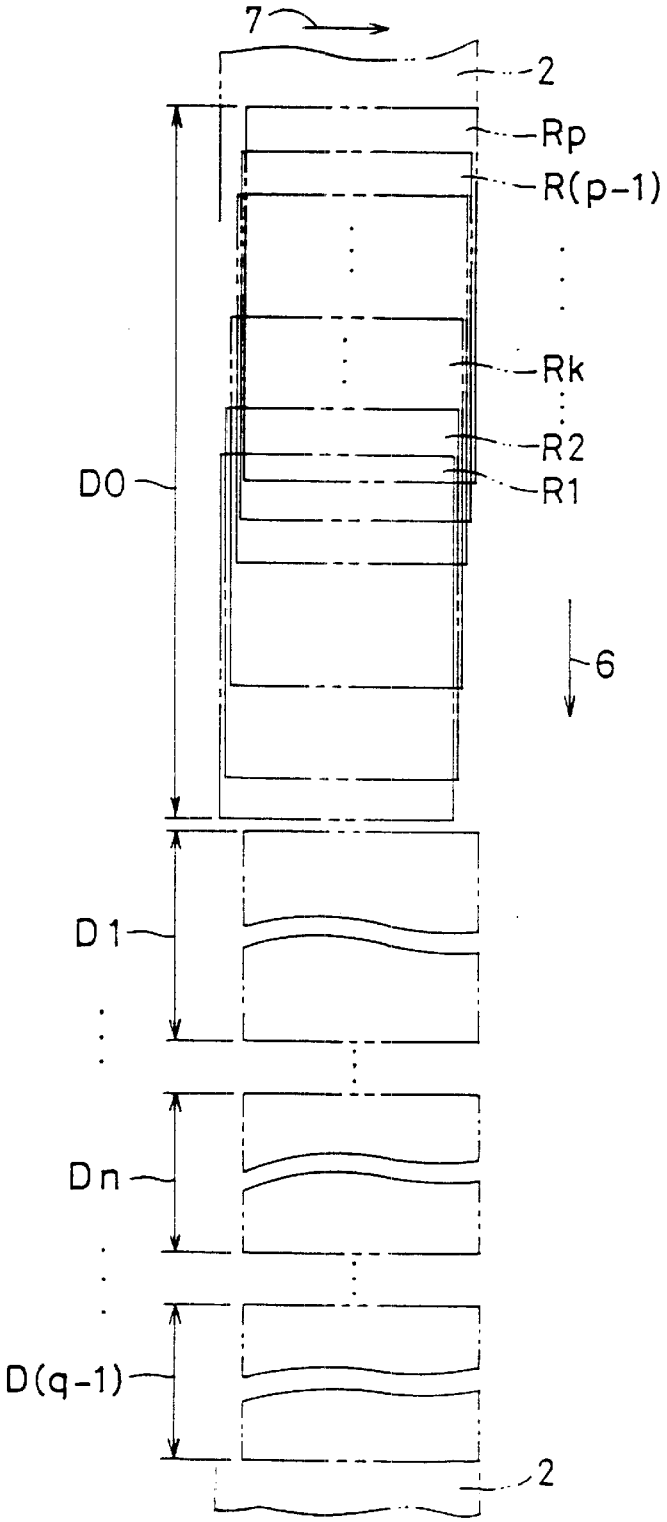
FIG. 5 is an illustration, showing the ink sheet 2 extending in a sub-scanning direction 6 of the ink sheet 2.

FIG. 5 illustrates the ink sheet 2 extending in the sub-scanning direction 6. The ink sheet 2 is divided into a plural number q of groups D0, . . . , Dn, . . . , and D(q−1) in the sub-scanning direction 6. Each of groups D0 to D(q−1) includes a plural number p of print areas Rp, . . . , Rk, . . . , and R1, which are arranged respectively offset next to one another in the sub-scanning direction 6. Print areas R1 to Rp are displaced next to one another in the sub-scanning direction 6 by an amount of each line L1 to Lf0 (see FIG. 7) that extend in the main scanning direction 7. In this way, print areas R1 to Rp are set in a virtual manner. According to another embodiment of the invention, the print area R1 to Rp may be arranged offset next to one another in the sub-scanning direction 6 by amounts of several lines of L1 to Lf0.

Figure 6:
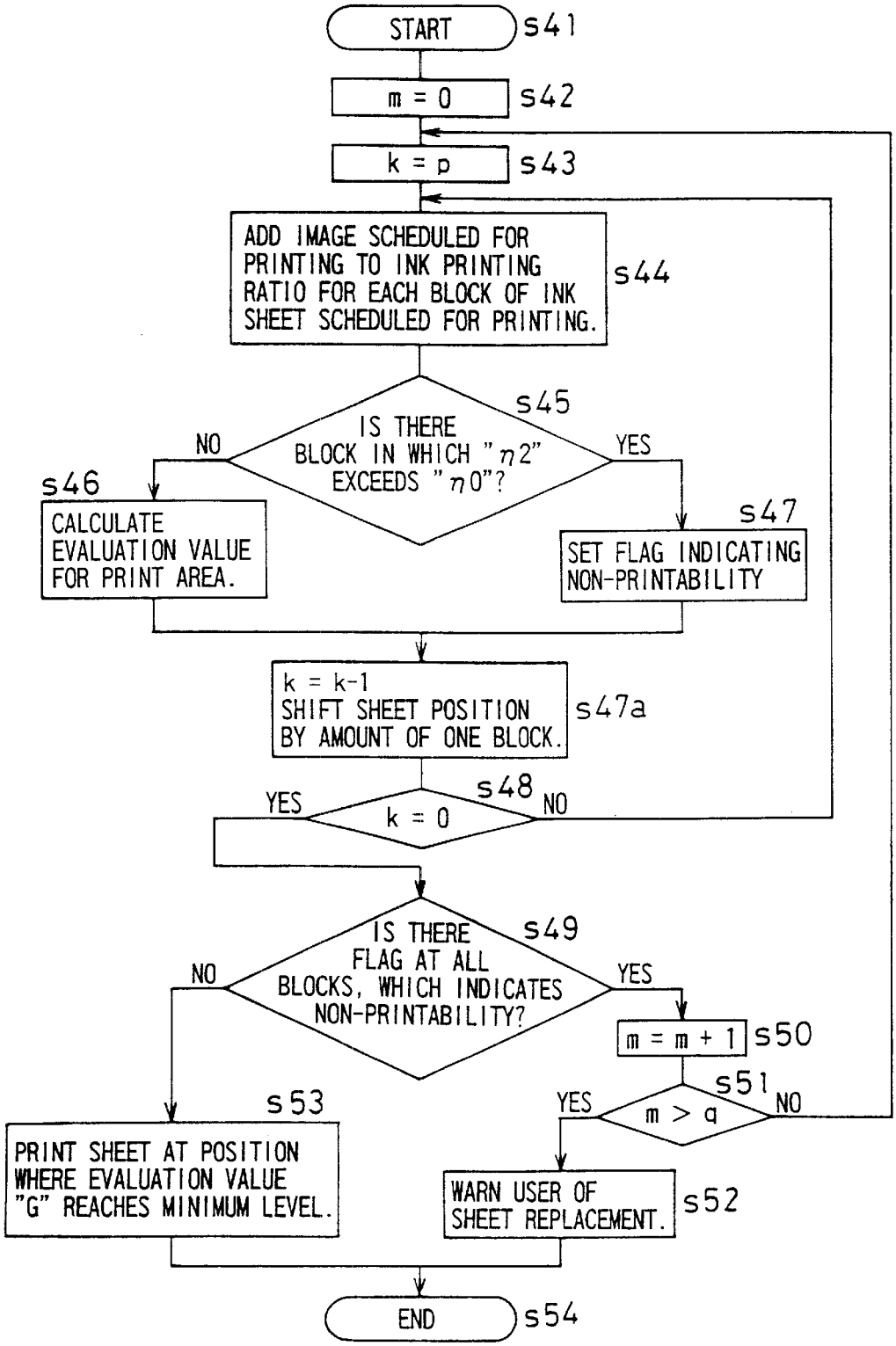
FIG. 6 is a flowchart, illustrating operations of a processing circuit 44 according to the embodiment as illustrated in FIGS. 1–5; and, FIG. 7 is an illustration, showing accumulated printing ratios η1, η2 in a block 15 in order to describe these printing ratios.

FIG. 6 is a flowchart, illustrating a course of action of the processing circuit 44 according to the embodiment of the invention as illustrated in FIGS. 1–5. The routine is advanced from step s41 to step s42 at which integer or variable m is set to be zero before the routine is moved to step s43. At step s43, variable k is set to be a predetermined first value p. Value p is the number of print areas R1 to Rp in each of groups D0 to D(q−1). For example, when print area Rp is set, then second accumulated printing ratio η2 for each of the blocks in print area Rp, responsive to the printing of an image to be printed, is calculated at step s44 using first accumulated printing ratio η1 for each of the blocks in print area Rp, which is obtained after the ink sheet is printed. First and second accumulated printing ratios η1, η2 will be discussed afterwards with reference with FIG. 7.

At step s45, a determination is made as to whether second accumulated printing ratio η2 for each of the blocks in set print area Rp exceeds predetermined value η0 (η2>η0). When the determination results in YES, then the routine is advanced to step s47. At step s47, flag F of theory 1 is set, which indicates that print area Rp is unprintable. The control memory 49 stores first accumulated printing ratios η1 for all of the blocks in main scanning and sub-scanning directions 7, 6. As previously discussed, second accumulated printing ratio η2 is calculated according the image data scheduled for printing, using first accumulated printing ratio η1 stored in the control memory 49. As illustrated in Table 1 below, the control memory 49 further stores, for each of group D0 to D(q−1), flags F that indicate whether print areas Rp to R1 are unprintable, and evaluation values G. Details of evaluation value G will be discussed afterwards.

TABLE 1

| | PRINT AREA | FLAG F | EVALUATION VALUE G |
|---|---|---|---|
| p | Rp | 1 | |
| p-1 | R(p-1) | 0 | c2 |
| p-2 | R(p-2) | 0 | c3 |
| | . | | |
| | . | | |

TABLE 1-continued

| | PRINT AREA | FLAG F | EVALUATION VALUE G |
|---|---|---|---|
| | . | | |
| k | Rk | 1 | |
| | | 0 | c5 |
| . | . | | |
| . | . | | |
| . | . | | |
| 1 | R1 | 1 | |

When it is determined at step s47 that print area Rp is unprintable, then flag F is set to be 1, signaling that print area Rp is unprintable as previously discussed. When it is determined at step s45 that second accumulated printing ratio η2 is equal to or less than predetermined value η0 (η2≦η0), then evaluation value G for print area Rp is calculated at step s46.

At step s47*a*, decrement is made to variable k by an amount of 1 after either steps s46 or s47 is completed. Then, the position in the sub-scanning direction 6 of the ink sheet 12 is shifted in a virtual manner by an amount of either predetermined one line or a predetermined plurality of lines. As a result, the following print area R(p−1) is ready for calculation. At step s48, a determination is made as to whether variable k is zero. When the determination in step s48 is NO, then the routine is returned to step s44, from which the same actions are repeated. In this way, flags F, which indicate whether the print areas Rp to R1 are unprintable, are set through all print areas Rp to R1 in one group, e.g., p. In addition, evaluation value G is calculated for each of print areas Rp to R1. Then, such flags F and evaluation values G are stored in the control memory 49. For example, Table 1 shows that evaluation values c2, c3, and c5 calculated at step s46 are stored according to print areas R(p−1), R(p−2), and so on.

Evaluation value G is an evaluation value for each of the print areas, which is related to at least either one of first and second accumulated printing ratios η1, η2. Evaluation value G is a value that corresponds to an amount of ink consumed in the print area. According to the embodiment of the invention, evaluation value G may be either a maximum or average value of second accumulated printing ratio η2 for all of the blocks in each of the print areas. Thus, evaluation value G is a value that corresponds to an amount of ink consumed throughout the print area.

When variable k is zero at step s48 in FIG. 6, then calculation of flags F and evaluation values G in all of print areas RP to R1 in group D0 are completed. A determination is made at step s49 as to whether flag F for each of print areas Rp to R1 in group D0 is theory 1, which shows that that particular print area is unprintable. When the determination in step s49 results in YES, then increment is made to variable m by an amount of 1 at step s50. At the following step s51, when variable m is equal to or less than predetermined value q (m≦q), then the routine is returned to step s43 from step s51. Meanwhile, when variable m is greater than predetermined value q (m>q), then warning is issued at step s52 in order to signal a user that the ink sheet 2 must be replaced. As a result, sharp image quality is achievable in print areas Rp to R1 in all groups D0 to D(q−1).

When the determination in step s49 results in NO, then any print area having minimum evaluation value G is selected at step s53. For example, when evaluation values G in Table 1 are c2<c3<c5, then print area R(p−1) defined by minimum evaluation value c2 is selected. The selected print area R(p−1) is used to print the ink sheet 2 on the record paper 5 in a thermal transfer manner.

After steps either s52 or s53 is completed, the routine is advanced to step s54 at which all actions are completed. At step s53, the selected print area containing a minimum consumption amount of ink is selected for printing. As a result, evaluation values G in all of print areas Rp to R1 in each of groups D0 to D(q−1) are averaged. This means that a nearly average amount of ink is consumed. Consequently, the ink sheet 2 is used with an increased efficiency, and there is no possibility that either a partially unused ink sheet 2 or an ink sheet 2 containing a reduced consumption amount of ink is discarded.

Figure 7:
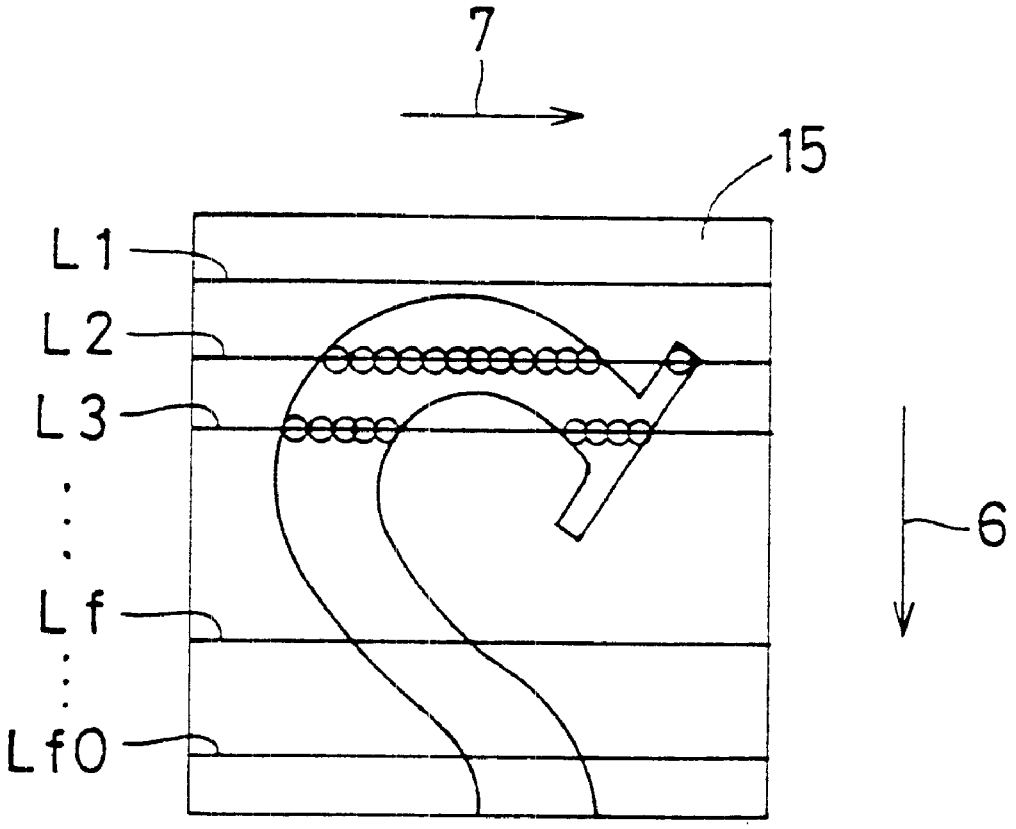

FIG. 7 illustrates accumulated printing ratios η1, η2 in the block 15 in order to describe these printing ratios. Reference characters L1 to Lf0 denote lines in the main scanning direction 7, provided by the printing head 33. The number of dots printed by heater elements for each line of L1 to Lf0 is stored in the control memory 49 for each number of times of printing at the blocks 15.

TABLE 2

| MAIN SCANNING LINE | NUMBER OF DOTS 1st PRINTING | 2nd PRINTING | . . . | dth PRINTING |
|---|---|---|---|---|
| L1 | 0 | | | |
| L2 | e11 | e21 | | |
| . | | | | |
| . | | | | |
| . | | | | |
| Lf | e12 | | | |
| . | | | | |
| . | | | | |
| . | | | | |
| Lf0 | e13 | | | |
| TOTAL NUMBER OF DOTS | e1 | e2 | . . . | e(d) |
| FIRST ACCUMULATED PRINTING RATIO | η1 = e1 + e2 + . . . + e(d) | | | |

For example, for main scanning line L2, the number of dots printed first time is e11, while the number of dots printed second time is e21. The number of dots printed first time at the block 15 is added together (e.g., e11+e12+e13), thereby determining e1 or the total number of dots. Similarly, printing ratios e2 to e(d) according to second or greater time of printing are calculated. First accumulated printing ratio η1 (=e1+e2+ . . . +e(d)) is determined for each of the blocks 15, which corresponds to a consumption amount of ink upon completion of printing. Assuming that the number of dots at the blocks of an image to be printed for each of the blocks 15 is e(d+1), then first accumulated printing ratio η1 and printing ratio e(d+1) are added together, thereby determining second accumulated printing ratio η2 (=η1 +e(d+1)).

First and second accumulated printing ratios η1, η2 are values that correspond to amounts of ink consumed at the blocks 15.

In addition to the thermal transfer printing apparatus, the invention is widely embodied in the following: a printing apparatus constructed to allow distal ends of a large number of needles to strike against an ink sheet, thereby printing an image on a sheet of record paper that is disposed on the side opposite to the needles with respect to the ink sheet; and, other types of printing apparatus.

The invention can widely be embodied in the facsimile apparatus as well as other information-processing apparatus and communication apparatus.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An ink sheet type-printing apparatus designed to use an ink sheet in recording on a sheet of record paper a number of times at a same position thereof, comprising:

moving means for permitting the ink sheet to be moved in a sub-scanning direction of thereof;

first calculating means for dividing the ink sheet in a virtual manner into a plurality of blocks in both a main scanning direction of the ink sheet and the sub-scanning direction thereof, and further for calculating accumulated printing ratios η1, η2 for each of the blocks, which correspond to amounts of ink to be consumed for printing;

second calculating means in response to an output from the first calculating means, for calculating an evaluation value for each of a plurality of print areas different in the sub-scanning direction of the ink sheet, the evaluation value being related to accumulated printing ratios η1, η2; and, print area-deciding means in response to an output from the second calculating means, for deciding a print area of the ink sheet to be used, according to the evaluation value, and for forcing the moving means to move the ink sheet in the sub-scanning direction of the ink sheet in order to carry out printing on a sheet of record paper using the decided print area of the ink sheet.

2. The ink sheet type-printing apparatus of claim 1, wherein the first calculating means calculates second accumulated printing ratio η2 for each of the blocks of the ink sheet, responsive to the printing of an image to be printed, using first accumulated printing ratio η1 for each of the blocks of the ink sheet, which is obtained after the ink sheet is printed, and the second calculating means calculates evaluation value related to second accumulated printing ratio η2.

3. The ink sheet type-printing apparatus of claim 2, wherein the print area-deciding means includes:

accumulated printing ratio-comparing means for comparing second accumulated printing ratio η2 for each of the blocks in each of the print areas with predetermined value η0 in order to determine whether the former η2 is equal to or less than the latter η0; and, comparison-deciding means in response to an output from the accumulated printing ratio-comparing means, for deciding that any print area consisting of only blocks that have second accumulated printing ratio η2 equal to or less than predetermined η0 is used for printing.

4. The ink sheet type-printing apparatus of claim 3, wherein the comparison-deciding means decides that from among a plurality of print areas consisting of only blocks having second accumulated printing ratio η2 equal to or less than predetermined η0, any print area having evaluation values related to accumulated printing ratios η1, η2that correspond to a small consumption amount of ink is used for printing.

5. The ink sheet type-printing apparatus of claim 3, wherein the ink sheet is divided into a plural number q of groups in the sub-scanning direction of the ink sheet, each of the groups including a plural number p of print areas that are arranged respectively offset next to one another in the sub-scanning direction of the ink sheet, and wherein the comparison-deciding means decides that, when the print area to be used for printing is absent in a group, the print area to be used for printing in the other groups is used for printing.

6. The ink sheet type-printing apparatus of claim 4, wherein the ink sheet is divided into a plural number q of groups in the sub-scanning direction of the ink sheet, each of the groups including a plural number p of print areas that are arranged respectively offset next to one another in the sub-scanning direction of the ink sheet, and wherein the comparison-deciding means decides that, when the print area to be used for printing is absent in a group, the print area to be used for printing in the other groups is used for printing.

7. The ink sheet type-printing apparatus of claim 1, wherein length LB2 of the block in the sub-scanning direction of the ink sheet is set to be equal to or greater than an error ΔLB in traveling of the ink sheet.

8. The ink sheet type-printing apparatus of claim 1, wherein the ink sheet has detected portions spaced apart from each other by a distance LB1 in the sub-scanning direction of the ink sheet, and the moving means includes detecting means for detecting the detected portions of the ink sheet in order to detect a position in the sub-scanning direction of the ink sheet, and movement control means in response to an output from the detecting means, for permitting the decided print area of the ink sheet to be moved to a position at which the ink sheet is printed on a sheet of record paper.

* * * * *